US005170728A

United States Patent [19]

Tanari

[11] Patent Number: 5,170,728

[45] Date of Patent: Dec. 15, 1992

[54] PROCESS AND FURNACE FOR TREATING FUSIBLE WASTE

[75] Inventor: Rene Tanari, Serignan Du Comtat, France

[73] Assignee: Indra S.A., Bollene, France

[21] Appl. No.: 673,988

[22] Filed: Mar. 25, 1991

[30] Foreign Application Priority Data

Mar. 23, 1990 [FR] France ..... 90 03727

[51] Int. Cl.[5] ..... F23G 7/00

[52] U.S. Cl. ..... 110/346; 110/232; 110/237; 422/184

[58] Field of Search ..... 110/235, 237, 346; 422/184

[56] References Cited

U.S. PATENT DOCUMENTS 4,602,574 7/1986 Bach et al. ..... 110/346
4,632,690 12/1986 Colwell .
4,666,696 5/1987 Situltz ..... 110/237 X
4,831,943 5/1989 Aune ..... 110/346
4,895,678 1/1990 Ohtsuka et al. ..... 110/237 X
5,000,101 3/1991 Wagner ..... 110/346

FOREIGN PATENT DOCUMENTS 3247349 5/1984 Fed. Rep. of Germany .
2454677 11/1980 France .
2157062 10/1985 United Kingdom .

*Primary Examiner*—Edward G. Favors
*Attorney, Agent, or Firm*—Cushman, Darby & Cushman

[57] ABSTRACT

A waste treatment furnace comprises a crucible equipped with heating means, a waste intake duct opening into the bottom of the crucible, a duct for removing matter from a bath opening into the crucible at a level above the level of the opening of the waste intake duct, the upper part of the furnace defining a chamber which communicates at the top with a duct for the effluent gases, an inlet ramp for a flushing gas opening into the combustion chamber.

8 Claims, 1 Drawing Sheet

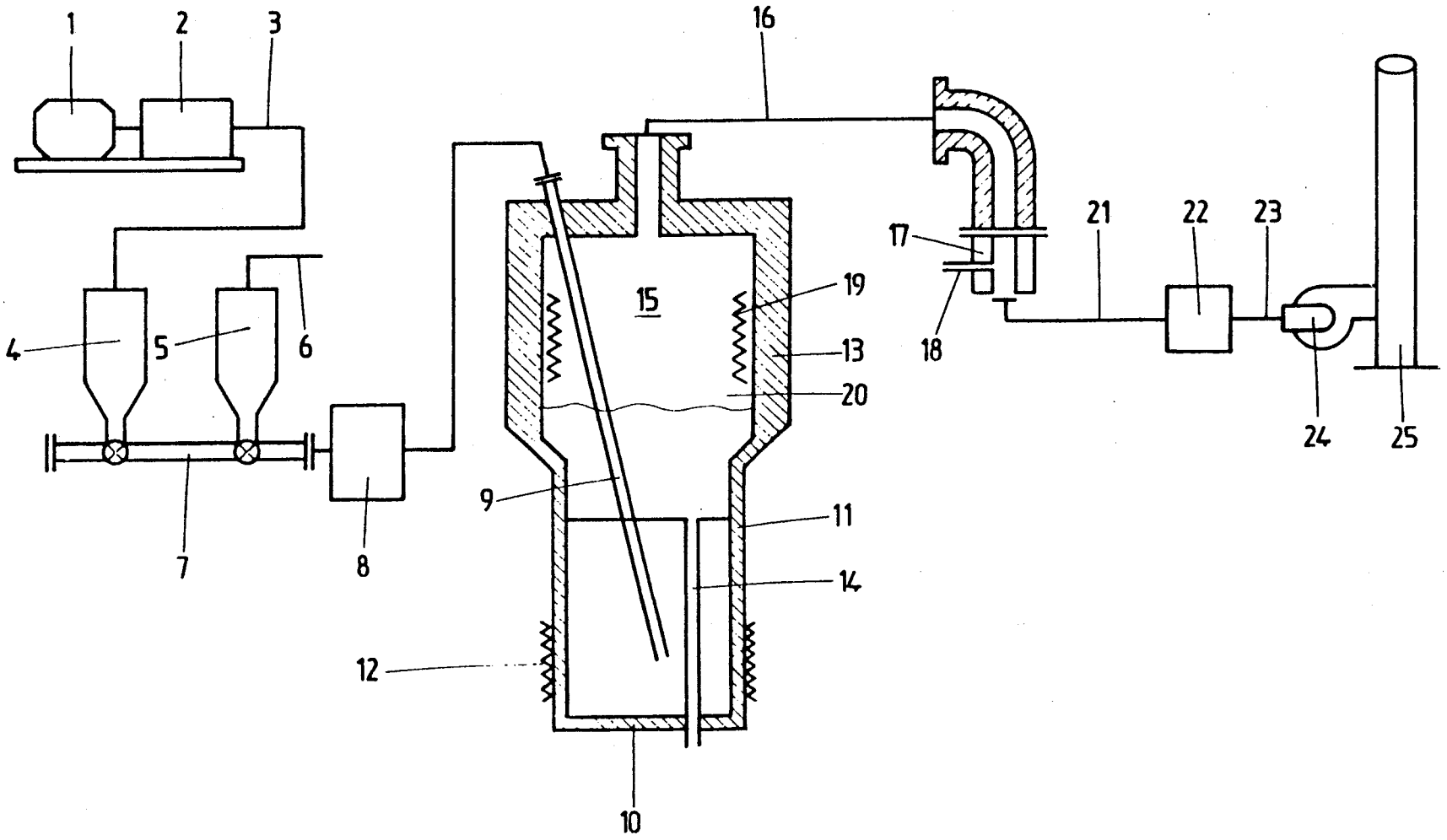
1
2
3
4
5
6
7
8
9
10
11
12
13
14
15
16
17
18
19
20
21
22
23
24
25

PROCESS AND FURNACE FOR TREATING FUSIBLE WASTE

This invention relates to processes for treating fusible waste, particularly toxic waste or slightly radioactive waste, consisting chiefly of contaminated oxides or fusible salts, particularly those based on siliceous products. This waste includes, more especially, clays, diatomaceous earth, contaminated laboratory flasks and glassware, glass fibres or wools such as those found particularly in fireproofing systems for buildings or effluent circuits in laboratories, factories and nuclear power stations, or encountered when ventilation filters for nuclear installations or chemical industries are replaced.

Currently, high temperature fusion of this waste is considered to be the best treatment to ensure safe packaging by modifying the geometry of the waste and by vitrification and for totally neutralising the solid and gaseous toxic contaminants. However, the present technique is unsatisfactory since the fusion of this waste requires very high temperatures (1700° C. for clays) which make the apparatus expensive to produce and operate. Furthermore, aerosols interfere with the purifying systems. Finally, the cinder which becomes welded to the bottom of the furnace is difficult to recover and repackage.

The invention relates to a process for treating contaminated fusible waste which overcomes the disadvantages mentioned above. The process does not require any apparatus which is expensive to produce and operate, the treated waste is compact and has good mechanical strength. The purification of the waste gases is no longer interfered with by aerosols.

The waste treatment process according to the invention consists in successively grinding the waste to a particle size of less than 2 mm, adding a flux thereto so as to bring the eutectic melting point of the mixture to a temperature below 1100° C., bringing the mixture of ground waste and flux into the lower part of a bath at a temperature below 1100° C., by means of a carrying gas, so as to concentrate the waste in the bath, cooling the concentrated bath in a container and leaving it to solidify.

There is no attempt, as before, to melt the waste at a high temperature. The waste is melted and dissolved at a lower temperature in a eutectic bath which is easy to pour at a later stage, thus overcoming all the problems of cleaning the bottom of the furnace.

Preferably, the driving pressure of carrying gas is just greater than the pressure corresponding to the height of the column formed by the molten bath. The quantity of gas given off is thus reduced. The volatile products are not displaced in the extraction circuit.

To maintain the temperature of the furnace it is advantageous for only part of the bath to be poured into the container.

Advantageously, the height of the bath is at least 30 cm above the intake level of the waste, for a bath temperature ranging from 1000° to 1100° C. This length is sufficient to enable the waste to dissolve in the bath and for the pyrolysis of any organic substances contained in the waste to take place.

Good results have been achieved when the mass of the bath represents 2 to 6 times the hourly mass flow rate of the waste.

Advantageously, the process consists in introducing a gas above the bath in order to pick up the toxic aerosols.

Preferably, the bath, silica-based, consists substantially of the same chemical elements as those of the waste which is to be treated and in the same proportions. Fusible additives or fluxes such as $B_2O_3$, $Na_2O$ and borax are added to this bath in order to lower the melting point of the bath for modification of the eutectic point of the mixture. The same proportion of fusible additives is added to the waste, so that its composition becomes substantially identical to that of the bath.

The invention also relates to a waste treatment furnace, characterised in that it comprises a crucible provided with heating means, a waste intake duct opening into the bottom of the crucible, a duct for taking matter from a bath, this duct opening into the crucible at a level above the opening of the waste intake duct, the top of the crucible communicating with an evacuation chamber made of refractory material, into the top of which opens an evacuation duct, whilst a gas intake duct opens into the evacuation chamber.

In the accompanying drawing, the sole FIGURE is a diagram illustrating a waste treatment installation according to the invention, the valves and other regulating means having been omitted from the drawing.

The installation comprises a cryogenic grinding unit, made up of a crusher and shredder 1 and a granulator 2, which operates at −120° C. The ground waste is passed through a duct 3 to a first metering device 4. A second metering device 5 is supplied by a duct 6 from a source of additive. The two metering devices 4 and 5 open into a duct 7 which is supplied by an air source at one end and which leads to a mixing cyclone 8. From here it goes through a rod 9 which passes through the side wall of a furnace and opens out near the bottom 10 of said furnace. The furnace made of refractory material has two distinct parts. A crucible 11, made of refractory steel at the bottom, containing a molten siliceous bath, is equipped with heating means 12, and a top part 13 made of refractory material.

A pouring rod 14 passes through the base 10 and opens into the crucible at a height of 400 mm.

The upper part 13 of the furnace defines, above the bath, an evacuation chamber 15 communicating via an evacuation duct 16 with a cooler 17 operating with air/air supplemented with cooling air through a duct 18. The chamber 15 has heating means 19 and an inlet ramp 20 for a flushing gas intended to drive the gas products into the duct 16.

The cooler 17 communicates, via a duct 21, with a very high efficiency filter 22 for eliminating aerosols. The filter 22 communicates via a duct 23, with a fan 24 and a chimney 25.

EXAMPLE 1

In the installation shown in the drawing, very high efficiency ventilating filters are treated which are made up of a metal framework covered with a filtering medium consisting of glass fibres bonded by an acrylic resin. After the metal framework has been removed, cryogenic grinding is carried out at −120° C. in the crusher 1 within the granulator 2. The powder obtained, which has a particle size of less than 1 mm, is passed to the metering device 4 which despatches 500 g per minute into the duct 7. The metering device 5 despatches 390 g of flux additives per minute into the duct 7. The flow rate of air passing into the duct 7 is 3 normal $m^3$ per hour of compressed air.

The furnace consists of refractory steel. The crucible 11 containing the molten bath has a diameter of 500 mm and a height of 1000 mm (capacity: 296 liters). At the start of the treatment the bath height is 400 mm (78 liters corresponding substantially to 195 kg). This mass constitutes the permanent liquid residue remaining in the crucible at a temperature of 1000° C. The rod 14 opens into the crucible at a level which is 400 mm higher than the base 10. The rod 9 for injecting the waste is 100 mm above the base 10.

The evacuation chamber 15 is 900 mm in diameter and 700 mm high, corresponding to a volume of about 450 liters. 100 $m^3$ of air per hour are introduced through the ramp 20 in order to dilute and evacuate the gases proceeding from the thermal treatment, which consist essentially of $CO_2$ and water vapour.

At the exit from the air/air cooler 17, the gas temperature is brought from 1100° C. to a level below 100° C. by dilution with air. For this purpose, 560 normal $m^3$ of air per hour are passed through the duct 18. This air is at a temperature of 20° C. The temperature leaving the cooler 17 is 60° C.

The bath contains 60% by weight of $SiO_2$ and 40% by weight of a mixture of $B_2O_3$ and $Na_2O$. Its melting point is 900°±20° C. In operation, its temperature is 1000°±50° C.

For a waste introduction rate of 30 kg per hour, the variation in volume of the bath is 14 liters per hour and partial pouring of this bath of 110 liters is carried out every 8 hours.

The chemical composition of the poured glass obtained varies as a function of time. After 8 hours' treatment, analysis of the glass corresponds to 58% by weight of $SiO_2$ and 42% by weight of $Na_2O$ and $B_2O_3$.

The bath is regenerated completely by adding 3.5 kg of $SiO_2$ every 8 hours.

The waste gases consist of $CO_2$ coming from the carbonate added among the fluxes and from the pyrolysis of the organic substances, water and air. The composition thereof is as follows:

$CO_2$: 5 normal $m^3$ per hour,
$H_2$: 6 normal $m^3$ per hour,
air: 50 normal $m^3$ per hour.

Only a waste gas containing 99% of air at 20° C. is released into the environment. Any contaminants are imprisoned in the cast glass or trapped on the filter 22.

Hitherto, there have been no satisfactory methods of packaging these ventilating filters. They were compacted in their original packaging and coated with concrete in specific containers. The proliferation coefficient of a product of this kind was very great. A concrete filter block measuring 1 $m^3$ contains only 50 kg of glass fibres.

The process according to the invention makes it possible to reduce the volumes by a coefficient of about 45, whilst achieving a compact packaging which is non-leechable and has good mechanical strength.

EXAMPLE 2

Chrysotile, used for fire-proofing buildings and effluent circuits in laboratories and nuclear power stations, is treated. The treatment is carried out in the installation shown in the drawing, in the manner described in Example 1, except that the metering device 4 delivers 330 g of ground waste per minute into the duct 7, whilst the metering device 5 delivers 215 g of fusible additives per minute into the duct 7. The flow rate of air in this duct 7 is 3 normal $m^3$ per hour. The air is pressurised.

100 normal $m^3$ per hour of diluting air are introduced over the ramp 20.

Through the duct 23, 650 normal $m^3$ of air per hour are passed at a temperature of 20° C. As it leaves the cooler 23 the waste gas is at a temperature of about 60° C.

The composition of the bath is 52% by weight of $SiO_2$, 18% by weight of MgO and 30% by weight of $B_2O_3$, $Na_2O$. Its melting point is 950°±20° C. Its operating temperature is 1000°±30° C.

The variation in the volume of the bath for an intake flow rate of 20 kg per hour is 10 liters per hour and 80 liters are poured out every 8 hours. The composition of the product poured out does not develop in the course of time. Analysis of the poured out glass, after 8 hours of treatment, is identical to the chemical composition of the initial bath.

The effluents comprise 5 normal $m^3$ of $CO_2$ per hour, 5 $m^3$ of $H_2O$ and 750 $m^3$ of air per hour. An effluent consisting of 99% air at a temperature of 20° C. is released into the atmosphere. The contaminants are imprisoned within the cast glass or trapped on the specific filter.

Hitherto, there have been no satisfactory methods of packaging contaminated chrysotile. High temperature fusion was carried out with a plasma torch (2400° C.), but the installation and operating costs were very great and the safety level was arguable.

Using the treatment process according to the invention, 300 liters of these fire-proofing agents are converted into 150 kg of cast "glass", i.e. about 70 liters.

The process according to the invention makes it possible to reduce 4 times the initial volume with an inexpensive installation whilst producing a compact, non-leechable packaging having good mechanical strength.

I claim:

1. Process for treating waste based on mineral products fusible at a temperature greater than 1200° C., comprising successively grinding the waste to a particle size of less than 2 mm, adding a flux thereto so as to bring the eutectic melting point of the mixture to a temperature below 1100° C., carrying the mixture of ground waste and flux into the lower part of a bath at a temperature less than 1100° C., by means of a carrying gas, so as to concentrate the waste in the bath, then pouring the concentrated bath into a container and leaving it to solidify therein.

2. Process according to claim 1, wherein the bath has substantially the same composition as the mixture of waste and flux.

3. Process according to claim 1, wherein the drive pressure of the carrying gas is just greater than the pressure corresponding to the height of the column formed by the molten bath.

4. Process according to claim 1, comprising pouring only part of the bath into the container.

5. Process according to claim 1, wherein the bath has a height of at least 30 cm above the waste intake level, for a bath temperature of 1000° to 1100° C.

6. Process according to claim 1, wherein the mass of the bath constitutes 2 to 6 times the hourly mass flow rate of the waste.

7. Process according to claim 1, comprising introducing a carrying gas above the bath.

8. Waste treatment furnace, comprising a crucible having an upper part, a bottom and a top and provided with heating means, a waste intake duct opening into the bottom of the crucible, a duct for removing matter from a bath opening into the crucible at a level higher than the opening of the waste intake duct, the upper part of the furnace defining a chamber communicating at the top with a duct for waste gases, and an inlet ramp for a flushing gas which opens into the combustion chamber.

* * * * *